United States Patent [19]

Matsumoto

[11] 4,021,044

[45] May 3, 1977

[54] ELECTRICAL CIRCUIT BOARD GAME

[75] Inventor: Teruo Matsumoto, Tokyo, Japan

[73] Assignee: Epoch Company, Ltd., Tokyo, Japan

[22] Filed: Apr. 1, 1976

[21] Appl. No.: 672,776

[30] Foreign Application Priority Data

Aug. 15, 1975 Japan ..... 50-99304

[52] U.S. Cl. ..... 273/135 A; 273/1 E; 273/139

[51] Int. Cl.$^2$ ..... A63F 3/00

[58] Field of Search .... 273/130 AB, 135 A, 136 A, 273/131 A, 137 A, 134 A, 138 A, 1 E, 139; 35/9 C, 19 A

[56] References Cited

UNITED STATES PATENTS

| | | | |
|---|---|---|---|
| 1,647,276 | 11/1927 | Daman | 35/9 C |
| 2,013,958 | 9/1935 | Hughes | 273/139 |
| 2,104,718 | 1/1938 | Dougherty | 35/9 C |
| 2,133,676 | 10/1938 | Walaity | 273/139 |
| 2,442,014 | 5/1948 | Myers | 273/130 AB |
| 2,893,137 | 7/1959 | Alling et al. | 35/19 A |
| 2,918,287 | 12/1959 | Rosenblum et al. | 273/136 A |
| 3,401,940 | 9/1968 | Abram | 273/139 |
| 3,640,536 | 2/1972 | Godmer | 273/130 AB |
| 3,982,764 | 9/1976 | Dieball | 273/135 A |

FOREIGN PATENTS OR APPLICATIONS

| | | | |
|---|---|---|---|
| 873,160 | 4/1953 | Germany | 273/139 |
| 1,277,721 | 6/1972 | United Kingdom | 35/9 C |

*Primary Examiner*—Anton O. Oechsle
*Assistant Examiner*—Harry G. Strappello

[57] ABSTRACT

An electrical circuit board game having a casing, a playing surface provided on the casing, a plurality of openings within the playing surface that are spaced apart from each other a uniform distance and arranged in a pre-determined pattern, indicia on the surface arranged in connecting relationship between adjacent of the openings, the indicia designating in part certain open junctions or potential connections in an electrical circuit, a supporting surface within the casing positioned below the playing surface, a plurality of separated, electrically conductive strips mounted on the supporting surface such that a portion of one of the strips is positioned directly below each of the openings in the playing surface, the strips being arranged such that the path between adjacent of certain of the openings defines a potential connection between adjacent of the strips, an electrical signal and a source of electrical energy connected to two of the plurality of conductive strips at opposite ends of the supporting surface, a plurality of electrically conductive playing pieces provided with arms that are spaced apart a distance corresponding to the distance the openings are spaced apart from each other, and to be positioned within adjacent of the openings selected by the player, and switching mechanisms for changing the orientation of the circuits.

4 Claims, 6 Drawing Figures

TOP PLAN VIEW

TOP PLAN VIEW
(COVER REMOVED)

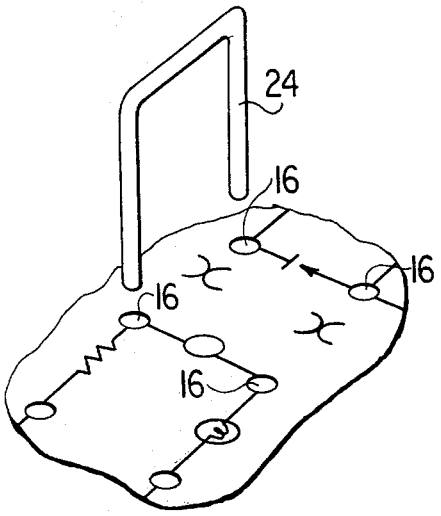
FIG. 3
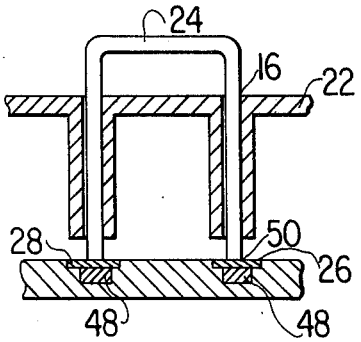
FIG. 4
FIG. 5
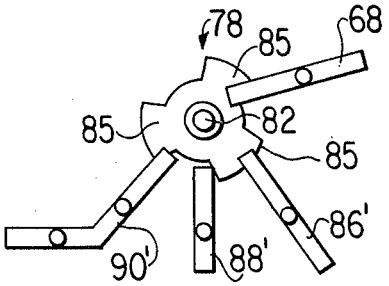
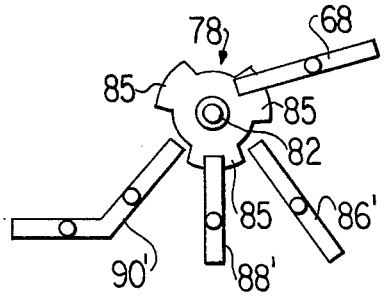
FIG. 6

ELECTRICAL CIRCUIT BOARD GAME

BACKGROUND AND SUMMARY OF INVENTION

The present invention relates to the general class of games wherein varying objectives are attained as a result of completing an electrical circuit. More particularly, the electrical circuit board game of the present invention is adapted to be used by two competing players who alternatively insert electrically conductive U-shaped playing pieces within openings formed in the top of the playing surface. Between the openings in the playing surface there are provided indicia designating an electrical circuit board. Eventually, one of the players will complete one of numerous possible circuits energizing both a buzzer and a light signalling that the player has lost. Additionally, there are provided at each end of the circuit board electrical contact switches which when rotated by the players change the orientation of the circuits, such that it is impossible for the players to memorize the steps necessary to complete a circuit.

BRIEF DESCRIPTION OF THE DRAWINGS

FIG. 3 is a perspective view of a portion of the circuit board game illustrating insertion of one of the U-shaped electrically conductive playing pieces within adjacent openings within the playing surface identified by the letter X;

FIG. 4 is a cross-sectional view of a portion of the circuit board game illustrating insertion of one of the U-shaped playing pieces within adjacent of the openings within the playing surface wherein it will be seen that the arms of the playing piece extend downwardly into engagement with adjacent of the electrical conductor strips, it being noted that magnetic inserts are positioned below the electrical conductor strips for the purpose of insuring tight engagement between the playing pieces and the conductor strips;

FIG. 5 is a top plan view of a portion of the circuit board game illustrating one of the rotating switches in a first position wherein certain electrical circuits are defined; and FIG. 6 is a top plan view of a portion of the circuit board game illustrating rotation of the electrical switch for the purpose of defining different potential circuits.

DESCRIPTION OF THE PREFERRED EMBODIMENT

Figure 1:
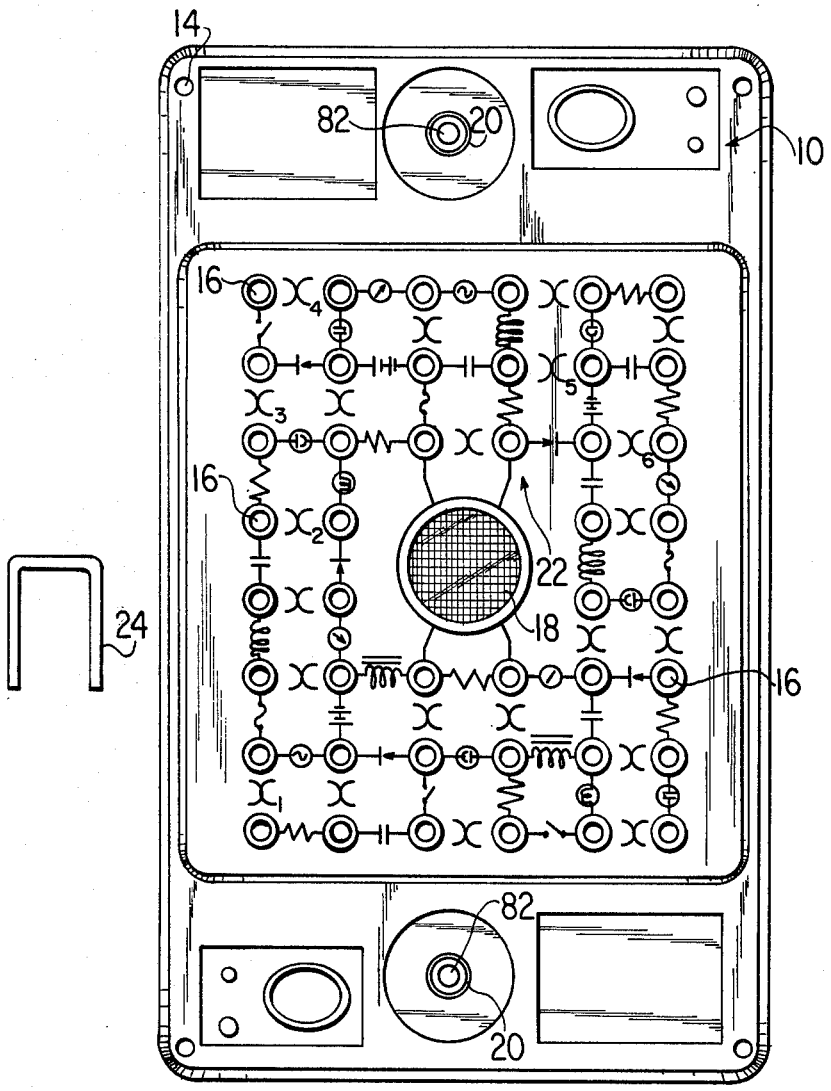
FIG. 1 is a top plan view of the electrical circuit board game of the present invention illustrating the plurality of openings in the top playing surface through which the ends of the U-shaped electrical conductive playing pieces are inserted, and the indicia between adjacent of the openings designating conventional electrical circuit symbols and as well the "X" marks located between adjacent of the openings identifying possible connections or junctions in the circuit which may be closed by the insertion of the aforementioned playing pieces.
Figure 2:
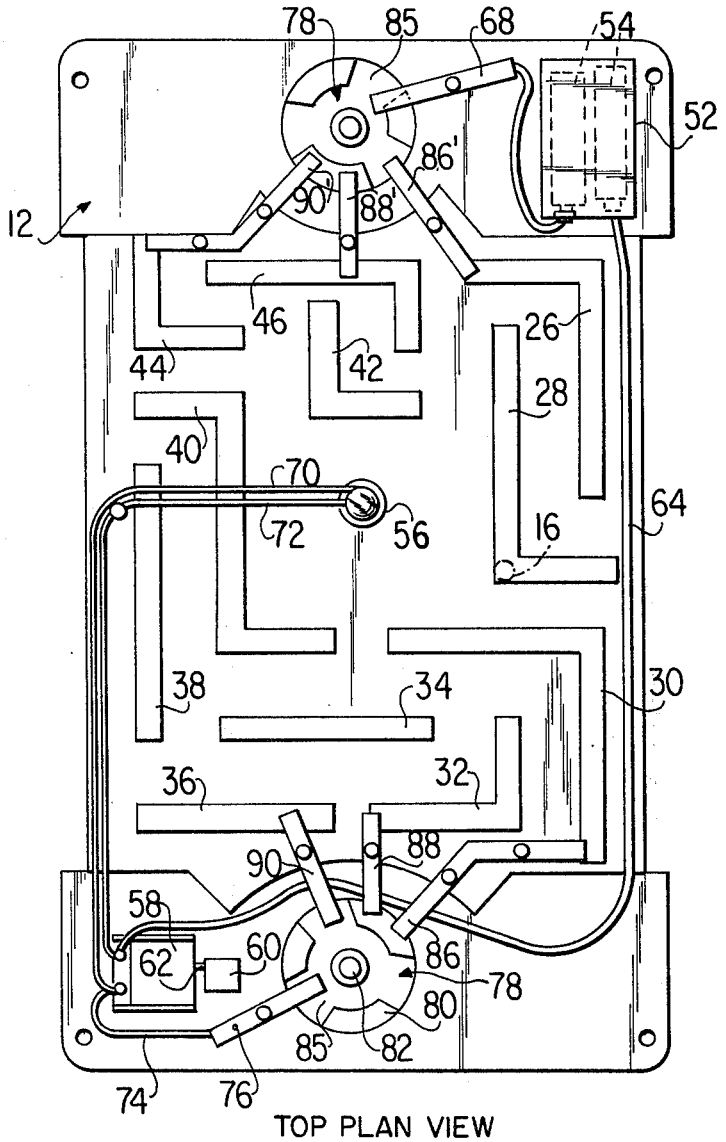
FIG. 2 is a top plan view of the electrical circuit board with the top cover removed so as to expose the working mechanism of the game, illustrating in particular the plurality of electrically conductive strips defining the various circuits, the rotating switch mechanisms at each end of the board which enable the players to change the circuits, the battery housing, electric light bulb and sound-producing motor and related wiring for signalling when any of the possible circuits has been completed.

As illustrated in FIGS. 1–2, the electrical circuit board game device of the present invention includes an outer casing designated by the reference numeral 10 and an inner casing 12 which is suitably fastened within the outer casing 10, for example, by screws 14. The outer casing 10 is provided with a plurality of openings 16 arranged in a predetermined pattern as will be explained in detail hereinafter. An illumination window 18 is provided in the center portion of the casing 10 while openings 20, the purpose of which will be explained in detail hereinafter, are provided at each end of the casing 10. Finally, it will be apparent from FIG. 1 that indicia designating various electrical symbols is provided on the playing surface 22 between adjacent of certain of the openings 16 while the space between adjacent of other of the openings 16 is marked with the letter X designating possible connections to be made by the players. From the foregoing it will be apparent that the game is played by each player in turn inserting the legs of one of the U-shaped electrically conductive playing pieces 24 within adjacent of the openings 16 between which a letter X appears.

Turning to FIG. 2, it can be seen that the inner casing 12 is provided with a plurality of electrically conductive strips 26, 28, 30, 32, 34, 36, 38, 40, 42, 44 and 46 of varying configuration. As seen in FIG. 4, the strips 26 et al are mounted along the surface of the inner casing 12 while a plurality of magnetic inserts 48 are positioned within openings provided in the inner casing 12 immediately below the conductive strips 26 et al and arranged to coincide with the pattern of openings 16 within the outer casing 10. That is, for each of the openings 16 within the outer casing 10 there is a corresponding magnetic insert 48 positioned below the corresponding conductor strip 26 et al. Thus, and as can be seen in FIG. 4, as the arms of one of the U-shaped electrically conductive playing pieces 24 are inserted within adjacent of the openings 16 within the playing surface 22 of the inner casing 10, the ends of the playing piece 24 are firmly held in electrical contact against the conductors 26 and 28 by the action of the magnetic inserts 48.

Returning to FIG. 2, it will be seen that the inner casing 12 is provided with a compartment 52 within which batteries 54 are located. Suitably mounted within the center of the inner casing 12 directly below the window 18 of the outer casing 10 is an electrical lamp 56 of conventional construction. Also mounted to the inner casing 12 is a miniature electric motor 58 of conventional construction having a weighted eccentric 60 mounted to the shaft 62 thereof such that as the motor 58 is energized and the shaft 62 rotates the eccentric weight 60 creates a noise. Since such noise producing construction is well known in the prior art, further elaboration is unnecessary.

Appropriate wiring is employed to electrically connect the components previously described, including wire 64 connecting the batteries 54 to one terminal of the motor 58, wire 66 connecting the batteries 54 to the electrical lead 68, wires 70 and 72 connecting the lamp 56 to terminals of the motor 58, and wire 74 connecting a terminal of the motor 58 to electrical lead 76, as will be explained hereinafter.

As illustrated in FIGS. 2, 5 and 6, at each end of the inner casing 12 there is provided a rotating electrical switching mechanism designated generally by the reference numeral 78. The switching mechanisms 78 are provided with non-conductive cylindrical bodies 80 terminating upwardly in knobs 82 being circular in configuration and which protrude upwardly through the openings 20 within the upper casing 10, as illustrated in FIG. 1. Positioned so as to cover selected portions of the active surface of each of the non-conductive bodies 80 is a coded, electrically conductive element 84. By "coded" it is meant that the electrically conductive element 84 has at least three conductive portions 85 at predetermined positions extending to the periphery of the non-conductive cylindrical body 80 so as to be capable of engaging the ends of the three conductor arms 86, 86′, 88, 88′, 90 and 90′, and as well the leads 68 and 76, previously described. It will be readily apparent from FIGS. 5 and 6, for example, that as each of the players rotates the knob 82 the switching mechanism 78 rotates such that the coded segments 85 of the conductive element 84 rotate to engage different of the arms 86, 88 and 90, as well as the leads 68 and 76, the result of which is to change the orientation and number of the circuits capable of energizing the lamp 56 and motor 58 by activating different of the conductor arms 86, 88 and 90.

It will be apparent from comparing FIGS. 1 and 2 that the electrical conductor strips 26 et al have been arranged in relationship to the openings 16 and the various indicia located on the playing surface 22 such that adjacent of the electrically conductive strips, for example, strips 26 and 28 as illustrated in FIG. 2, can only be connected as a result of positioning the arms of the U-shaped playing pieces 24 within adjacent openings 16 designated by a mark X. That is, if a playing piece 24 is positioned within adjacent openings 16 designated by one of the numerous electrical symbols illustrated in FIG. 1 there will not be formed a connection between adjacent of the conductor strips 26 et al since the two legs of the U-shaped playing piece 24 will contact only a single such conductor strip. But positioning a playing piece 24 between adjacent openings 16 designated by a mark X will always connect adjacent of the conductor strips 26 et al.

Tracing the multitude of circuits that are defined by rotating the knobs 82 of the switching mechanism 78 is possible from an analysis of FIG. 2. It will be apparent, for example, that when the rotating switching mechanisms 78 are positioned as illustrated in FIG. 2, the batteries 54, lamp 56 and motor 58 are appropriately connected with the wires 64, 66, 68, 70, 72 and 74 through leads 68 and 76 while the coded portions 85 of the conductive elements 84 conduct electricity to only the conductor arms 90 and 90′ which engage the conductor strips 36 and 26, respectively. It will be apparent, therefore, that the circuit will only be completed so as to energize the lamp 56 and motor 58 when the conductor strips 26 and 36 are connected. It will be further apparent from comparing FIGS. 1 and 2 that there are numerous paths available to connect the conductor strips 26 and 36 with the use of the U-shaped, electrically conductive, playing pieces 24. One such path, for example, is defined by the marks X, X2, X3, X4, X5 and X6, as illustrated in FIGS. 1 and 2. (The subscript notations, of course, do not appear on the playing surface defined by the outer casing 10, but are shown in the drawings for illustrative purposes only.)

With the foregoing in mind, it will be apparent that each of the players is permitted to rotate switching mechanism 78, after which each player in turn positions one of his U-shaped playing pieces 24 between any connection marked by the letter X. Sooner or later one of the players will complete a circuit at which time the lamp 56 will be illuminated and the motor 58 will operate to cause the eccentric weight 60 to make a buzzing sound signalling that the player positioning the last playing piece has "lost" the game.

I claim:

1. An electrical circuit board game, comprising a casing, a playing surface provided on said casing, a plurality of openings within said playing surface, said openings being spaced apart from each other uniform distances and arranged in a pre-determined pattern, indicia on said surface connecting adjacent of said openings, a supporting surface within said casing positioned below said playing surface, a plurality of separated, electrically conductive strips, means mounting said strips on said supporting surface such that a portion of one of said strips is positioned directly below each of said openings in said playing surface, said strips being arranged such that the path between adjacent of certain of said openings defines a potential connection between said adjacent strips, an electrical signal, a source of electrical energy, means connecting said signal and source of energy to certain of said plurality of conductive strips, and a plurality of electrically conductive playing pieces provided with arms spaced apart a distance corresponding to the distance said openings are spaced apart from each other to be positioned within adjacent of said openings selected by the player.

2. An electrical circuit board game as in claim 1, including means connecting said signal and source of energy to a different combination of said plurality of conductive strips.

3. An electrical circuit board as in claim 2, wherein said means connecting said signal and source of energy to a different combination of said plurality of conductive strips comprises a manually operable electrical switch mounted at each end of said casing and having a knob portion thereof extending upwardly through said playing surface, each of said switches comprising a non-conductive cylindrical portion, and a coded, electrically conductive element adjacent said non-conductive portion, flexible electrically conductive leads having end portions thereof arranged to engage said electrically conductive coded portions and said non-conductive portion, and means connecting said leads to different of said electrically conductive contact strips.

4. An electrical circuit game board as in claim 1, wherein said indicia includes a first designation connecting only those of said openings that correspond to adjacent of said conductive strips and at least a second designation connecting those of said openings that correspond to the same of said conducting strips.

* * * * *